US005403638A

United States Patent [19]

Yanagizawa et al.

[11] Patent Number: 5,403,638

[45] Date of Patent: Apr. 4, 1995

[54] FLOCKED MEMBER

[75] Inventors: Hirofumi Yanagizawa; Katsuhiko Oikawa; Atsushi Okada, all of Moriyama; Kyoji Muraoka, Kuga; Naoki Morozumi, Osaka; Haruo Kamiya, Tokyo, all of Japan

[73] Assignees: Mitsui Petrochemical Industries, Ltd., Tokyo; Gunze Limited, Kyoto, both of Japan

[21] Appl. No.: 191,597

[22] Filed: Feb. 4, 1994

[30] Foreign Application Priority Data

Feb. 5, 1993 [JP] Japan ..... 5-018957

[51] Int. Cl.[6] ..... B32B 33/00

[52] U.S. Cl. ..... 428/90; 428/97

[58] Field of Search ..... 428/90, 97

[56] References Cited

U.S. PATENT DOCUMENTS 4,424,647 10/1984 Sasaki et al. .
5,145,891 8/1992 Yasukawa et al. .
5,189,840 2/1993 Yanagizawa et al. .
5,284,009 2/1994 Tung et al. ..... 428/97

FOREIGN PATENT DOCUMENTS 232522 8/1987 European Pat. Off. .
234819 9/1987 European Pat. Off. .
270246 6/1988 European Pat. Off. .
4126645 2/1992 Germany .
131419 of 1981 Japan .
19446 5/1986 Japan .
189621 7/1992 Japan .

*Primary Examiner*—James C. Cannon
*Attorney, Agent, or Firm*—Sherman and Shalloway

[57] ABSTRACT

A flocked member having a base and a flock and characterized in that the flock is formed by filaments comprising a resin composition (E) or yarns comprising the filament, the resin composition (E) comprising per 100 parts by weight thereof:

(1) 90 to 2 parts byweight of a modified polyethylene composition (C) in the form of a mixture which includes 90 to 10 wt. % of a ultra-high-molecular-weight polyethylene (A) having an intrisic viscosity ($\eta$) of at least 6 dl/g, and 10 to 90 wt. % of a polyethylene (B) having an intrinsic viscosity ($\eta$) of 0.1 to 5 dl/g, at least one of the polyethylene (A) and the polyethylene (B) having been modified with at least one modifying monomer sclected from among unsaturated carboxylic acids and derivatives thereof, and (2) 10 to 98 parts by weight of a polyamide (D).

20 Claims, No Drawings

FLOCKED MEMBER

TECHNICAL FIELD

The present invention relates to flocked members which are outstanding in abrasion resistance, slip properties, resistance to compressive deformation, etc.

BACKGROUND ART

Flocked members have heretofore been widely used in various industrial fields, for example, as cleaning members for copying machines, printers, facsimile devices, etc., as brushing members for use in washing, printing and other processes, and as holders for the window glass of motor vehicles. The flocked members to be used as such members need to be generally excellent in properties including abrasion resistance, slip properties and resistance to compression deformation to meet the functional requirements. However, flocked members which are generally satisfactory in these properties still remain to be developed. For example, the product wherein the flock is made of filaments of nylon 6 and which is in wide use is excellent in resistance to compressive deformation but has yet to be improved in abrasion resistance and slip properties.

Accordingly, the main object of the present invention is to provide a flocked member which is generally outstanding in properties such as abrasion resistance, slip properties and resistance to compressive deformation.

SUMMARY OF THE INVENTION

We have conducted extensive research to solve or lessen the problem encountered with flocked members of the prior art and found that the above object can be achieved by using as the material of the flock a resin composition comprising a polyamide and a specified modified polyethylene resin composition to accomplish the present invention.

More specifically, the present invention provides a flocked member having a base and a flock and characterized in that the flock is formed by filaments comprising a resin composition (E) or yarns comprising the filament, the resin composition (E) comprising per 100 parts by weight thereof:

(1) 90 to 2 parts by weight of a modified polyethylene composition (C) in the form of a mixture which includes 90 to 10 wt. % of a ultra-high-molecular-weight polyethylene (A) having an intrisic viscosity ($\eta$) of at least 6 dl/g, and 10 to 90 wt. % of a polyethylene (B) having an intrinsic viscosity ($\eta$) of 0.1 to 5 dl/g, at least one of the polyethylene (A) and the polyethylene (B) having been modified with at least one modifying monomer selected from among unsaturated carboxylic acids and derivatives thereof, and (2) 10 to 98 parts by weight of a polyamide (D).

DESCRIPTION OF THE PREFERRED EMBODIMENTS

The flocked member of the present invention consists essentially of a base and a flock. With the flocked member embodying the invention, the flock may be formed directly on a surface of a base with an adhesive provided therebetween, or a fiber for forming the base and a fiber for forming the flock may be made into a knitted or woven pile fabric with the pile providing the flock.

The relation between the base and the flock is not limited specifically.

The material for the base is not limited specifically. Examples of useful materials are knitted or woven fabrics of synthetic and natural fibers, plastic films, molded or otherwise formed plastic pieces, metals, synthetic rubbers, natural rubber and other elastic materials. Also useful are shaped pieces, for example, of metals, plastics, rubbers or the like, as covered with a knitted or woven fabric of a fiber serving as the base material.

The material for the flock of the invention comprises filaments containing a resin composition (E) or yarns including such filaments. The resin composition (E) comprises a modified polyethylene composition (C) and a polyamide (D), the composition (C) including per 100 parts by weight thereof 90 to 10 parts by weight of a ultra-high molecular weight polyethylene (A) having an intrinsic viscosity ($\eta$) of at least 6 dl/g, and 10 to 90 parts by weight of a polyethylene (B) having an intrisinc viscosity ($\eta$) of 0.1 to 5 dl/g, the ultra-high-molecular-weight polyethylene (A) and/or the polyethylene (B) having been modified with at least one modifying monomer selected from among unsaturated carboxylic acids and derivatives thereof.

The components of the resin composition (E) for forming the flock material will be described below in detail.

(A) Ultra-high-molecular-weight polyethylene

The ultra-high-molecular-weight polyethylene (A) may be a homopolymer of ethylene or copolymer of ethylene and a monomer or monomers copolymerizable with ethylene. Examples of such monomers copolymerizable with ethylene are alpha-olefins having at least three carbon atoms.

Examples of useful alpha-olefins having at least three carbon atoms are propylene, 1-butene, isobutene, 1-pentene, 2-methyl-1-butene, 3-methyl-1-butene, 1-hexene, 3-methyl-1-pentene, 4-methyl-1-pentene, 1-heptene, 1-octene, 1-decene, 1-docosene, 1-tetradecene, 1-hexadecene, 1-octadecene, 1-eicosene and the like.

In the case where the copolymer is used as the polyethylene (A), it is desirable to use the copolymerizable monomer in an amount of up to about 10 moles per 100 moles of ethylene.

The polyethylene (A) usually has an intrinsic viscosity ($\eta$) of at least 6 dl/g, preferably 6 to 40 dl/g, more preferably 10 to 30 dl/g, as determined in decalin at 135° C.

Preferable among such ultra-high-molecular-weight polyethylenes (A) are those having a density (ASTM D1505) of at least 0.920 g/cm$^3$ and a melting point (Tm, ASTM D3417) of at least 115° C.

(B) Polyethylene

Like the polyethylene (A), the polyethylene (B) may be a homopolymer of ethylene, or copolymer of ethylene and a monomer or monomers copolymerizable with ethylene. Examples of useful monomers copolymerizable with ethylene are similar to those of polyethylene (A) given above.

When the copolymer is used as the polyethylene (B), it is desirable to use the copolymerizable monomer in an amount of up to about 10 moles per 100 moles of ethylene.

The polyethylene (B) usually has an intrinsic viscosity ($\eta$) of at least about 0.1 to about 5 dl/g, more preferably about 0.3 to about 4 dl/g, as determined in decalin at 135° C.

Preferable among such polyethylenes (B) are those having a density of about 0.92 to about 0.97g/cm$^3$ and a melting point of about 115° to about 135° C.

(C) Modified polyethylene composition

The modified polyethylene composition (C) comprises the ultra-high-molecular-weight polyethylene (A) and the polyethylene (B) at least one of which has been modified with at least one of unsaturated carboxylic acids and derivatives thereof.

The proportions of the polyethylene (A) and the polyethylene (B) in the modified polyethylene composition (C) are usually 90 to 10 parts by weight of the former and 10 to 90 parts by weight of the latter, preferably 80 to 10 parts by weight of the former and 20 to 90 parts by weight of the latter, more preferably 80 to 15 parts by weight of the former and 20 to 85 parts by weight of the latter, per 100 parts by weight of the combined amount of the two components. When the proportions are in these ranges, the mechanical strength afforded by the presence of the polyamide (D) to be described below will not be impaired, making it possible to provide a flock of excellent properties.

The monomer to be used for modifying the ultra-high-molecular-weight polyethylene (A) and/or the polyethylene (B) is an unsaturated carboxylic acid or derivative thereof. Examples of useful unsaturated carboxylic acids are acrylic acid, methacrylic acid, maleic acid, fumaric acid, itaconic acid, citraconic acid, crotonic acid, Nadic acid (endo-cis-bicyclo[2,2,1]-hept -5-ene-2,3-dicarboxylic acid) and the like. Examples of derivatives of these acids are acid halides, esters, amides, imides, anhydrides, etc. More specific examples are malenyl chloride, maleimide, acrylamide, methacrylic amide, glycidyl methacrylate, maleic anhydride, citraconic anhydride, monomethyl maleate, dimethyl maleate, glycidyl maleate and the like. These unsaturated carboxylic acids and derivatives thereof are used singly, or at least two of them are used in combination. Preferable monomer among these modifying monomers is maleic anhydride which is highly reactive and therefore gives products of satisfactory strength and appearance.

Various known processes are usable for modifying the polyethylene (A) and/or the polyethylene (B) with these monomers. The polyethylene (A) or the polyethylene (B) or both can be modified, for example, by suspending or dissolving them in a solvent and admixing the modifying monomer and a radical polymerization initiator with the suspension or solution usually at a temperature of about 80° to about 200° C. to effect graft polymerization, or by bringing modifying monomer and radical initiator into contact with the polyethylenes while these polymers are being kneaded in a molten state at a temperature not lower than the melting points thereof, for example, at a temperature of 180° to 300° C.

The modification ratio of the polyethylene (A) and/or the polyethylene (B) (the modifying monomer content of the modified polyethylene composition (C)), although not limited specifically, is usually about 0.001 to about 20%, preferably about 0.01 to about 10%, more preferably about 0.1 to about 5%, of the combined weight of the polyethylenes (A) and (B). If the modifying monomer content is excessively high, the flocked member exhibits an impaired color and becomes less resistant to abrasion, whereas if the content is too low, the modified polyethylene composition (C) will exhibit reduced affinity for the polyamide (D), similarly failing to afford a flocked member having a good appearance and excellent characteristics.

(D) Polyamide

Examples of useful polyamides (D) are polyamides obtained by the polycondensation of at least one of aliphatic diamines, alicyclic diamines, aromatic diamines and like diamines, such as hexamethylenediamine, decamethylenediamine, dodecamethylenediamine, 2,2,4- or 2,4,4-trimethylhexamethylenediamine, 1,3- or 1,4-bis(aminomethyl)cyclohexane, bis(p-aminocyclohexylmethane) and m- or p-xylylenediamine, with at least one of aliphatic dicarboxylic acids, alicyclic dicarboxylic acids, aromatic dicarboxylic acids and like dicarboxylic acids, such as adipic acid, suberic acid, sebacic acid, cyclohexanedicarboxylic acid, terephthalic acid and isophthalic acid; polyamides obtained by the condensation of ϵ-aminocaproic acid, 11-aminoundecanoic acid and like aminocarboxylic acids; polyamides obtained from ϵ-caprolactam, ω-laurolactam and like lactams; copolymerized polyamides comprising at least two of these components; and mixtures of at least two of these polyamides.

More specific examples of such polyamides are nylon 6, nylon 66, nylon 610, nylon 9, nylon 11, nylon 12, nylon 6/66, nylon 66/610, nylon 6/11, etc.

(E) Resin composition

The resin composition (E) to be used as the material for the flock of the flocked member of the present invention comprises the modified polyethylene composition (C) and the polyaimide (D) described above.

Per 100 parts by weight of the resin composition (E), the ratio of modified polyethylene composition (C) to polyamide (D) is usually approximately 90-2 parts:10-98 parts, more preferably approximately 70-3 parts:30-97 parts, by weight. If the amount of polyamide (D) is excessive, reduced slip properties will result, whereas insufficient amounts thereof entail, for example, lower resistance to compressive deformation.

The method of preparing the flocked member of the invention by flocking a knitted fabric, woven fabric or like base is not limited specifically. The flocked member can he prepared, for example, by flocking the base directly with loops or single fibers of filaments comprising the resin composition (E) or of yarns comprising such filaments using an adhesive, or by weaving or knitting hase-forming fibers and such filaments or yarns comprising the filament into a pile fabric, with its pile formed by the latter, and thereafter cutting the pile to form a flock by the cut pile. The flock-forming filaments may be in the form of spun yarns.

The woven or knitted pile fabric may be of single pile structure or double pile structure. Further when required, the pile-covered side and the opposite side of the fabric may be set with a suitable resin or adhesive so as to prevent the flock-forming filaments or yarns from slipping off more effectively.

The material for forming the base fabric in the form of a woven or knitted pile fabric, i.e., the kind of fibers forming the base is not limited specifically. Various fibers are usable which include synthetic fibers such as fibers of polyethylene terephthalate and like polyesters, polyamides, polypropylene and like polyesters, natural fibers such as animal hair, and semisynthetic fibers such as rayon fibers. The setting resin or adhesive is not limited specifically. For example, adhesives of acrylic resins or vinyl acetate resins are useful. A particular resin or adhesive is suitably selected for use in accordance with the kind of fibers, use of the flocked member, etc. According to the present invention, the flock need not only of the cut pile structure described. Also usable is flock formed by uncut loops, as provided by a knitted or woven single-pile fabric.

According to the invention, the flock may be formed alternatively by cutting filaments of the type mentioned or yarns comprising such filaments into short fibers, electrostatically treating the fibers when required and flocking a base directly with an adhesive, e.g., by electrostatic flocking. Thus, the method of forming the flock is not limited specifically with the present invention insofar as the base can be flocked.

The height of the flock is not limited specifically but varies widely depending on the use, and is generally, for example, about 0.2 to about 6.5 mm.

In the case where the filament is used as it is for forming the flock, the fineness of single filament is usually about 1 to abollt 30 D, preferably about 3 to about 15 D. When the yarn composed of filaments of the specified type is used, the fineness of the yarn is usually about 100 to about 2400 total denier, preferably about 800 to about 1500 total denier. However, the fineness values are not limited to these ranges but are of course variable depending on the use and material. The flock may be formed by filaments prepared from the resin composition (E) only, or by such filaments and filaments of other material in combination therewith. Further the flock-forming yarns are not limited to those comprising only the specified filament of the resin composition (E) of the invention but may be yarns comprising the specified filament and filaments of other material. The method of forming such yarns is not limited specifically. Known methods such as twisting and laying parallel are usable. In the case where filaments of different materials are used, the method of preparing yarns is not limited, either. Examples of useful methods are doubling and twisting, covering and laying parallel.

With the present invention, other filaments which may be used in combination with filaments of the resin composition (E) are not limited specifically. Examples of useful filaments are fibers of synthetic resins such as polyvinyl chloride resin, polyacrylnitrile resin and fluorocarbon resin, cotton, silk, hemp, wool and like natural fibers, and viscose rayon and like regenerated fibers.

The resin composition (E) is spun into filaments by the process to be described below. For spinning, it is desired to use the spinneret at an elevated temperature. However, as the resin temperature rises, the resin tends to drip from the orifice. It is therefore likely that the composition is difficult to spin when the spinneret is in contact with a tubular radient heater disposed under the spinneret. Accordingly, it is desired to position the radient heater about 2 to about 30 mm, preferably about 5 to about 15 mm, away from the spinneret. Of course depending on the relation between the size of orifice and the desired fineness of filament, the resin temperature need not be high, or the radient heater may be in contact with the spinneret, or the radient heater can be dispensed with. Further in spinning, the extrudate emerging from the orifice may be cooled with water immediately. Other conditions involve no particular limitations. In the case where water cooling is resorted to, difficulty will be encountered in increasing the spinning rate. In this case, it will be necessary to reduce the orifice size. Accordingly, suitable conditions are selectively employed in spinning the resin composition of the invention, and the present invention is in no way limited by the spinning conditions described above.

Further although not essential, it is desirable, for example, to provide a filter in the vicinity of the breaker plate at the forward end of the cylinder. A wide variety of filters ranging from a mesh filter to a gel filtration filter for filtering gels are usable. Suitable other thermoplastic resin can be admixed with the resin composition to be spun. Examples of useful thermoplastic resins are polymers previously exemplified, such as polyolefin resins and polyester resins, and any other resins. The amount of resin to be used, although not limited specifically, is for example up to about 40% of the amount by weight of the resin composition (E), preferably about 1 to about 5% thereof. The thermoplastic resin may be used not as blended with the composition (E) but in the form of a polymer alloy with the composition. Also usable as added to the resin composition (E) are known fillers such as carbon black, silica, fluorocarbon resin powder, silicone powder, silicone oil, etc.

After the completion of spinning, the filaments may be subjected to known treatments such as drawing and heat teatment when so required. Although not limited specifically, the drawing conditions are, for example, about 50° to about 150° C. and drawing ratio of about 1 to about 4 times.

The flocked member of the present invention is used, for example, as a cleaning member for use in copying machines, printers, facsimile devices; brushing member for cleaning and printing processes; ground member for artificial skiing grounds; holder for holding a glass panel or other member which is slidable relative thereto or movable in contact therewith for use in automatic doors and motor vehicles.

The flocked member of the present invention are excellent in properties such as abrasion resistance, slip properties and resistance to compressive deformation, and are therefore extremely useful in various fields of industries other than those given above.

EXAMPLES

Examples, comparative example and test example are given below for a better understanding of the features of the present invention.

A resin composition (E) was prepared in the following manner for use in the examples of the invention.

(a) Modified polyethylene composition (C)

Ultra-high-molecular-weight polyethylene (A): 21 dl/g in intrinsic viscosity ($\eta$)

Polyethylene (B): 1.5 dl/g in intrinsic viscosity ($\eta$)

(A)/(B): 75 wt. %/25 wt. %

The above mixture of (A) and (B) was modified in its entirely with maleic anhydride through graft polymerization to prepare a resin composition containing 1 wt. % of maleic anhydride (modifying monomer).

(b) Polyamide (D)

Nylon 6 (product of Toray Industries, Inc., trademark "Amiran CMlOO7")

(c) Resin composition (E)

Polyamide (D)/modified polyethylene resin (C): 80 wt. %/20 wt. %

EXAMPLE 1

The resin composition (E) in an amount of 97 parts by weight was mixed with 3 parts by weight of a masterbatch of polyamide (D) having a carbon black concentration of 10 wt. %, and the mixture was made into filaments of 6D using 30-mm extruder having a full-flight screw, 25 in L/D. The spinning conditions were cylinder temperature 180° to 255° C., flange temperature 255° C., head temperature 265° C., die temperature 270° to 290° C., temperature of radient heater 250° C., screw speed 3 r.p.m., resin pressure 10 kgf/cm$^2$, and discharge rate 870 g/hr. The drawing temperature was 120° C., and the drawing rate was set at an optimum value between 180 and 350 m/min. The nozzle had 64 orifices, 0.5 mm in diameter. A gel filter, 5 μm filtration precision, was used. A tubular heater serving as a radient heater was provided under the nozzle of the die, with a spacing of 10 mm formed between the nozzle and the radient heater. A spinning tube was disposed at a position downstream from the radient heater so as to be held out of contact with the heater.

The filaments obtained were 2.3 g/D in strength and 38% in elongation. The filaments were cut to a length of 0.5 mm, and a base sheet of synthetic rubber was flocked with cut filaments using a polyurethane adhesive to obtain a flocked member. The flocked member thus prepared was fitted around a steel roll having a diameter of 10 mm and bonded thereto with an adhesive to obtain a cleaning member for copying machines.

EXAMPLE 2

A rubber roll was directly flocked with cut filaments 0.5 mm in length and obtained in the same manner as in Example 1, using a urethane adhesive to prepare a cleaning member for copying machines.

EXAMPLE 3

Pile yarns were used which were prepared by twisting filaments obtained in the same manner as in Example 1 into multifilaments of 6D ×50F, for forming a pile portion which was designed with pick counts of 16 warps/cm and 30 wefts/cm. Teflon spun yarns (two No. 20 count warps and two No. 20 count wefts) were used for forming a base fabric which was designed with pick counts of 40 wefts/inch and 60 warps/inch. The yarns were woven into a moquette weave (double pile fabric), followed by cutting to prepare a cut pile fabric. The pile length was 5.5 mm, and the pile portion was useful as flock. One side of the fabric opposite to the flocked side was treated with a resin for setting to prevent the flock yarns from slipping off.

In this way, a flocked member was obtained, which was then fitted around a steel roll in the same manner as in Example 1 to obtain a cleaning member for use in copying machines.

Comparative Example 1

A cleaning member was prepared in the same manner as in Example 2 using 6-D filaments obtained in the same manner as in Example 1 with the exception of using only the same nylon 6 resin as used in Example 1.

Test Example 1

The cleaning members obtained in Examples 1 and 2 and Comparative Example 1 were tested for abrasion resistance, slip properties, resistance to compressive deformation and suitability for use as cleaning members. Table 1 shows the results.

With reference to Table 1 showing the test results, the abrasion resistance was evaluated according to the following criteria.

A: No apparent change was found in the flock.

B: An apparent change was found in the flock, and not satisfactory to use.

C: A marked change in the flock, and unusable.

The suitability for use as the cleaning member was evaluated according to the following criteria based on the overall evaluation of properties including abrasion resistance, slip properties and resistance to compressive deformation.

A: Highly useful.

B: Not fully useful.

C: Difficult to use.

TABLE 1

| Item | Test conditions | Example 1 | Example 2 | Comp. Ex. 1 |
|---|---|---|---|---|
| Abrasion resistance: 10,000 sliding strokes | Load: 700 g/cm$^2$<br>Speed: 150 mm/sec<br>Stroke length: 800 mm | A | A | B |
| Slip properties: Coefficient of dynamic friction (μd) | Counter member: SUS 304<br>Load: 280 kg/cm$^2$ | 0.24 | 0.27 | 0.42 |
| resistance to compressive deformation (%) | Load: 2.8 kg/cm$^2$ | 0 | 0 | 0 |
| | 5.6 kg/cm$^2$ | 3 | 5 | 6 |
| Suitability as cleaning member | | A | A | B |

The results shown in Table 1 reveal that the flocked members embodying the invention have excellent characteristics.

We claim:

1. A flocked member having a base and a flock and characterized in that the flock is formed by filaments comprising a resin composition (E) or yarns comprising the filament, the resin composition (E) comprising per 100 parts by weight thereof:

(1) 90 to 2 parts byweight of a modified polyethylene composition (C) in the form of a mixture which includes 90 to 10 wt. % of a ultra-high-molecular-weight polyethylene (A) having an intrisic viscosity (η) of at least 6 dl/g, and 10 to 90 wt. % of a polyethylene (B) having an intrinsic viscosity (η) of 0.1 to 5 dl/g, at least one of the polyethylene (A) and the polyethylene (B) having been modified with at least one modifying monomer selected from among unsaturated carboxylic acids and derivatives thereof, and (2) 10 to 98 parts by weight of a polyamide (D).

2. A flocked member as defined in claim 1 wherein the polyethylene (A) in the modified polyethylene composition (C) has an intrinsic viscosity (η) of 6 to 40 dl/g.

3. A flocked member as defined in claim 2 wherein the polyethylene (A) in the modified polyethylene composition (C) has an intrinsic viscosity (η) of 10 to 30 dl/g.

4. A flocked member as defined in claim 1 wherein the polyethylene (A) in the modified polyethylene composition (C) has a density of at least 0.920 g/cm$^3$ and a melting point of at least 115° C.

5. A flocked member as defined in claim 1 wherein the polyethylene (B) in the modified polyethylene composition (C) has an intrinsic viscosity (η) of 0.3 to 4 dl/g.

6. A flocked member as defined in claim 1 wherein the polyethylene (B) in the modified polyethylene composition has a density of 0.92 to 0.97 g/cm$^3$ and a melting point of 115° to 145° C.

7. A flocked member as defined in claim 1 wherein the polyethylene (A)/polyethylene (B) ratio of the modified polyethylene composition (C) is 80-10 wt. %: 20-90 wt. %.

8. A flocked member as defined in claim 7 wherein the polyethylene (A)/polyethylene (B) ratio of the modified polyethylene composition (C) is 80-15 wt. % 20-85 wt. %.

9. A flocked member as defined in claim 1 wherein the modifying monomer for the polyethylene (A) and/or the polyethylene (B) in the modified polyethylene composition (C) is maleic anhydride.

10. A flocked member as defined in claim 1 wherein the modification ratio of the polyethylene (A) and/or the polyethylene (B) in the modified polyethylene composition (C) is 0.001 to 20 wt. %.

11. A flocked member as defined in claim 10 wherein the modification ratio of the polyethylene (A) and/or the polyethylene (B) in the modified polyethylene composition (C) is 0.01 to 10 wt. %.

12. A flocked member as defined in claim 10 wherein the modification ratio of the polyethylene (A) and/or the polyethylene (B) in the modified polyethylene composition (C) is 0.1 to 5 wt. %.

13. A flocked member as defined in claim 1 wherein the polyethylene composition (C)/polyamide (D) ratio of the resin composition (E) is 70-3 wt. %:30-97 wt. %.

14. A flocked member as defined in claim 1 wherein the flock has a structure formed by electrostatic flocking.

15. A flocked member as defined in claim 1 wherein the flock is formed by a cut pile.

16. A flocked member as defined in claim 1 wherein the filaments comprise the resin composition (E) and a thermoplastic resin other than the resin composition (E).

17. A flocked member as defined in claim 16 wherein the thermoplastic resin other than the resin composition (E) is at least one of a polyolefin resin and polyester resin.

18. A flocked member as defined in claim 16 wherein the thermoplastic resin other than the resin composition (E) is present in an amount of up to 40% of the amount by weight of the resin composition (E).

19. A flocked member as defined in claim 18 wherein the amount of the thermoplastic resin is 1 to 5% of the amount by weight of the resin composition (E).

20. A flocked member as defined in claim 1 wherein the flock is formed by filaments comprising the resin composition (E) and filaments comprising other material.

* * * * *